US006055923A

United States Patent [19]

Militzer

[11] Patent Number: 6,055,923

[45] Date of Patent: May 2, 2000

[54] ANCHOR BAG AND SYSTEM

[76] Inventor: George G. Militzer, 1402 Carleton Sq., San Diego, Calif. 92106

[21] Appl. No.: 09/104,342

[22] Filed: Jun. 25, 1998

[51] Int. Cl.[7] ..... B63B 21/22

[52] U.S. Cl. ..... 114/210; 114/294

[58] Field of Search ..... 114/210, 294; 441/84

[56] References Cited

U.S. PATENT DOCUMENTS

| | | | |
|---|---|---|---|
| 3,143,993 | 8/1964 | Salerno | 114/210 |
| 3,977,448 | 8/1976 | Botting | 114/210 |
| 4,004,625 | 1/1977 | Zietlow, Jr. | 114/294 |
| 4,926,780 | 5/1990 | Wiehagen | 114/311 |
| 5,341,758 | 8/1994 | Strickland | 441/84 |
| 5,394,818 | 3/1995 | Walker, II et al. | 114/294 |
| 5,419,275 | 5/1995 | Wood | 114/311 |

*Primary Examiner*—Sherman Basinger

*Attorney, Agent, or Firm*—Frank G. Morkunas

[57] ABSTRACT

An anchor bag and system for use with a rode and an anchor having an anchor stock, an anchor shank, an anchor crown, and an anchor fluke. The bag has an opening at one end, a closed section at the opposite end, and an inner chamber for accepting, properly coiling, and stowing the rode. The anchor is retained on the outside of anchor bag by a releasable shank support and by a separate fluke support. The opening of the bag is selectably closable by a pull string. The closed section has a reinforced rode passage through which the bitter end of the rode is retained. A plurality of drainage portals are situated on the outer surface of the bag. Carry handles are positioned on the bag such that the composite weight of the anchor bag system (with anchor and rode stowed therein) is distributed equally on either side of the center points of the carry handles. The rode is chainlessly attached to the anchor and, from the anchor end, has internal weights thereon extending a distance of between approximately 2.5% to 12.5% of its total length.

25 Claims, 3 Drawing Sheets

ANCHOR BAG AND SYSTEM

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

This present invention relates to an improvement in anchor bags, and more particularly to an improvement to a complete anchor system for easily stowing, storing, and deploying an anchor from its container. Various anchors and anchor systems have been used by mariners for many years. The purpose of the anchor generally is to prevent a boat from drifting and to slow down a boat by creating a drag. In some instances deployment of an anchor may be leisurely performed; in others and emergency situations, rapid deployment is a must. The manner in which an anchor is stowed in relation to its container relates directly to its deployability. Most storage systems do not facilitate rapid deployment.

Several anchor bags and systems currently exist and are in use. These include bags and systems found in U.S. Pat. No. 3,977,448 issued to Botting; U.S. Pat. No. 4,926,780 issued to Wiehagen; U.S. Pat. No. 5,394,818 issued to Walker; and U.S. Pat. No. 5,419,275 issued to Wood. Each comprises a storage bag, a drainage mechanism, an anchor, and relative ease of deployability and stowability after use. Of these, the Botting patent ('448) most closely resembles the present invention.

The structure of the anchor bag system contemplated by the present invention, however, incorporates the structure of the inside diameter of the bag in relation to the outside diameter of the rode such that stowability and deployability are greatly facilitated and enhanced. In addition, the rode is chainless incorporating internal weights to off-set the lack of a chain and the weight associated therewith. Typically the chain on a rode provides weight to hold the anchor shank relatively parallel to the surface bottom when deployed which thereby permits the flukes to 'grab' or set into the surface bottom. Because of their structure chains foul easily when stowed thereby adversely affecting rapid deployment. The chainless rode with internal weights provides the weight necessary for a deployed anchor to properly function and eliminates potential fouling. Moreover, hoisting an anchor by hand with a chain can be difficult; difficult to grasp, difficult to hold, and difficult to pull. The chainless internally weighted rode eliminates that difficulty.

Finally, all the systems associated with the prior art are structured to stow the associated anchor within the container. This hinders smooth and rapid deployment of the anchor when needed. Fouling and snarling of the rode and catching of the stock or flukes on the container, and the like greatly impedes deployment of the anchor when needed and particularly when time may be of the essence. In addition to the structural features associated with the present invention, the outer surface of the bag is structured to releasably contain an anchor within a shank support as well as within a fluke support and has protective caps attached to the bag fitted for the stock to protect against damage when the anchor bag, with stowed anchor, is moved about. Though the prior art systems are suited for their intended purposes, the present invention is far superior in overall use and storage.

Accordingly, several objects and advantages of my invention are to:

- provide a durable and inexpensive anchor bag system for the end-user;
- facilitate storage of the rode and anchor after use;
- facilitate deployability of the anchor when needed;
- eliminate fouling, snarling, and twisting of the rode upon storing the rode and upon deploying the anchor; and
- prevent the anchor flukes from catching on the container when deploying the anchor.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention which contemplates an anchor bag and system for use with a rode and an anchor having an anchor stock, an anchor shank, an anchor crown, and a pair of, or twin, anchor flukes. The bag has a mouth at one end, a closed end at the opposite end, and an inner chamber for accepting, properly and naturally coiling, and stowing the rode. Natural coiling is realized by properly structured diameter ratios between the inner diameter of the bag in relation to the outside diameter of the rode which should bear a ratio of between approximately 16.0:1 to approximately 19.5:1. The anchor is retained on the outside of anchor bag by a releasable shank support and by a fluke support. The mouth of the bag is selectably closable by a pull string. The closed end has a reinforced rode passage through which the bitter end of the rode is retained. A plurality of drainage portals are situated on the outer surface of the bag. Carry handles are positioned on the bag such that the composite weight of the anchor bag system (with anchor and rode stowed therein) is distributed equally on either side of the center points of the carry handles. The rode is chainlessly attached to the anchor and, from the anchor end, has internal weights thereon extending a distance of between approximately 2.5% to 12.5% of its total length.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
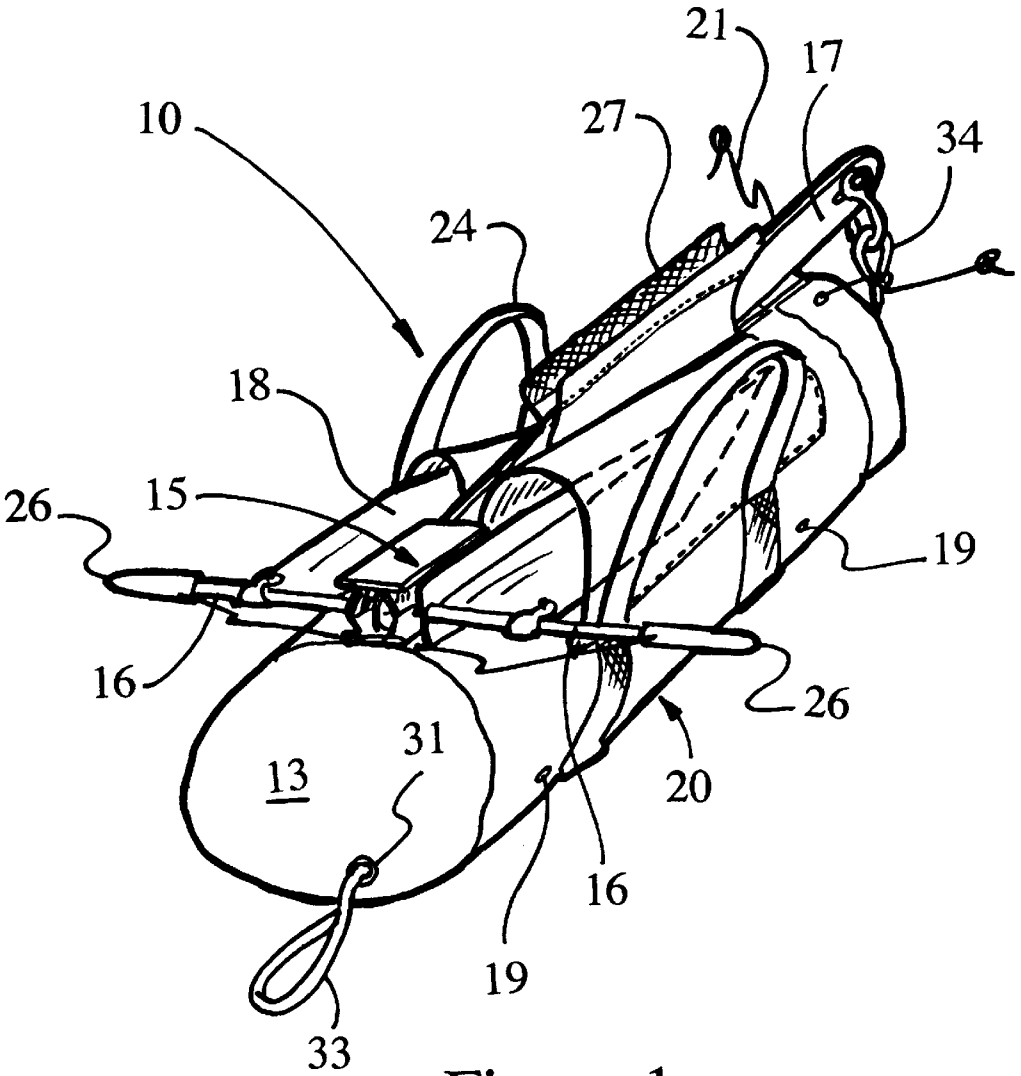
FIG. 1 is a perspective view of the anchor bag system.

Referring now to the drawings in detail and in particular to FIG. 1, reference character 10 generally designates an anchor bag system constructed in accordance with a preferred embodiment of the present invention. FIG. 1 illustrates the system 10 with the anchor 15 stowed onto the container or bag 20. The bag may be constructed generally of a heavy-duty reinforced waterproof material. Any synthetic material or canvas will suffice. The bag should be somewhat cylindrical in shape, the reasons for which will be explained later. Generally a Danforth- or fluke-type anchor is contemplated for use with this anchor bag system although the system structure may accommodate other anchor types.

The rode 30 (not seen in this figure) is naturally coiled inside the bag 20. The anchor end of the rode 34 is visible from one end, the front or mouth end, and the bitter end of the rode 33 protrudes from the rode passage or aperture 31 on the closed end 13 of the bag 20. The bitter, or eye-spliced, end of the rode 30 is adapted to be cleated or otherwise to be attachable to a boat in a conventional manner. The anchor shank 17 is held to the bag 20 by the anchor support 27 on the outer surface of the bag 20. The shank support 27 is shown in this embodiment as two flap-like structures connected to the outer surface of the bag 20. The flap-like structures are joinable, generally by placing one flap over the anchor shank 17 and overlapping the other flap onto the first flap. Each flap of the shank support 27 has cooperating fasteners suited for the intended purpose, including, but not limited to hook-and-loop, male and female snaps, and hook-and-eye. Because of their relative ease of use, hook-and-loop are the preferred fasteners.

Also holding the anchor 15 to the bag 20 are one or more fluke supports 28. The fluke support 28 may be a pocket-like structure on the outside of the bag 20 adapted to receive and hold an anchor fluke 18. For a Danforth-type anchor, the pocket-like structure is somewhat triangularly shaped internally for the purpose of supporting the fluke when inserted therein. Any pocket-like structure, however, may suffice depending on the type of anchor being used. For added support, the pocket-like structure may include a draw string or similar tie-down or closing mechanism (not shown) at an open end of the pocket-like structure to secure the opening and, thereby, more securely retaining the fluke therein.

The anchor stock 16 of a typical Danforth-type anchor projects outward from the bag 20 when stowed on the bag. Stock protectors, such as removable end caps 26, are connected to the bag 20 for placing on the ends of the anchor stock 16 to protect against damage the protruding anchor stock 16 may cause when the anchor is stowed in the anchor storage system 10 and is moved about. The end caps 26 may be made of any material suited for the intended purpose, including, but not limited to rubber and rubber-like materials, polymers, foam and foam-like materials, and the like.

The bag 20 may rest as illustrated in FIG. 1, may be rolled to either side and placed at rest, or may rest on its closed end 13. Because of these potentials, and because the rode and anchor after use and stowage, remain wet for a period of time, a plurality of drainage portals 19 are structured throughout to permit the water to drain from the bag 20.

The mouth end 14 of the bag 20 has a closing feature to secure the rode 30 within the bag 20. In the embodiments illustrated, the closing feature is a draw string 21 around the circumference of the mouth end 14 which can be drawn and tied after so drawn. Any suitable closing structure, adjacent to the mouth end 14, suited for the intended purpose, including, but not limited to hook-and-loop fasteners, hook-and-eye fasteners, male and female snap fasteners, and the like, may be utilized for this structure.

Rounding out the description of the bag 20 is a carrying structure on the outside of the bag for carrying the bag 20 as needed. In FIG. 1, the carrying structure consists of one or more carry handles 24. The carry handles 24 are unique to the anchor bag system in that, when structured as a complete system, with anchor, rode, and bag all of a pre-determined structure and respective weight, the placement of the carry handles 24 is such that, from the point of holding the bag (or from the center point of the carry handles 24), the composite weight is evenly distributed on either side of the center point of the carry handles 24. Such weight distribution, by placement of the carry handles 24, makes it easier to hold and carry the anchor bag with stowed anchor thereon.

The carry handles 24 may be fixed in place on the bag 20, as described above, when the entire system is constructed; or the carry handles 24 may be re-positionable on the outer surface of the bag 20. This structure of re-positionable handles envisions use of cooperating fasteners on the bag 20 and on the carry handles 24. Such suitable fasteners could include, but not be limited to, hook-and-loop fasteners, hook-and-eye fasteners, male and female snap fasteners, and the like.

Figures 2, 3:
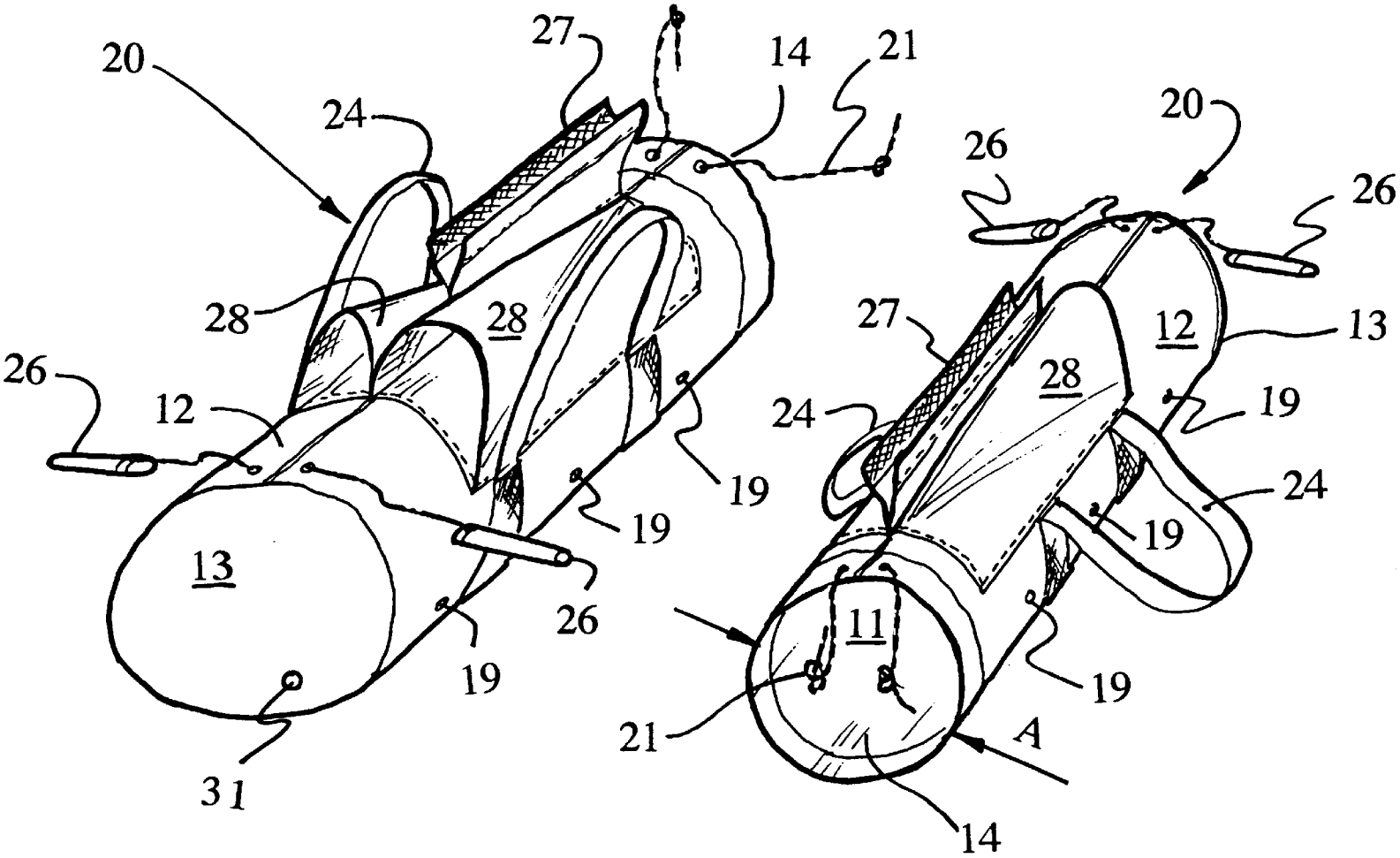
FIG. 2 is a perspective rearview of the anchor bag.
FIG. 3 is a perspective front view of the anchor bag.

FIGS. 2 and 3 illustrate the bag 20 without the anchor 15 or the rode 30. The outside surface of the bag 20 is designated by reference numeral 12, the inside surface or chamber within the bag is designated by reference numeral 11. The mouth or open end of the bag 20 is designated by reference numeral 14. The rode passage 31 generally is a reinforced aperture; reinforced by a grommet or similar structure to add strength to the rode passage 31 and lengthen the useful life of the bag 20 thereby.

Figure 4:
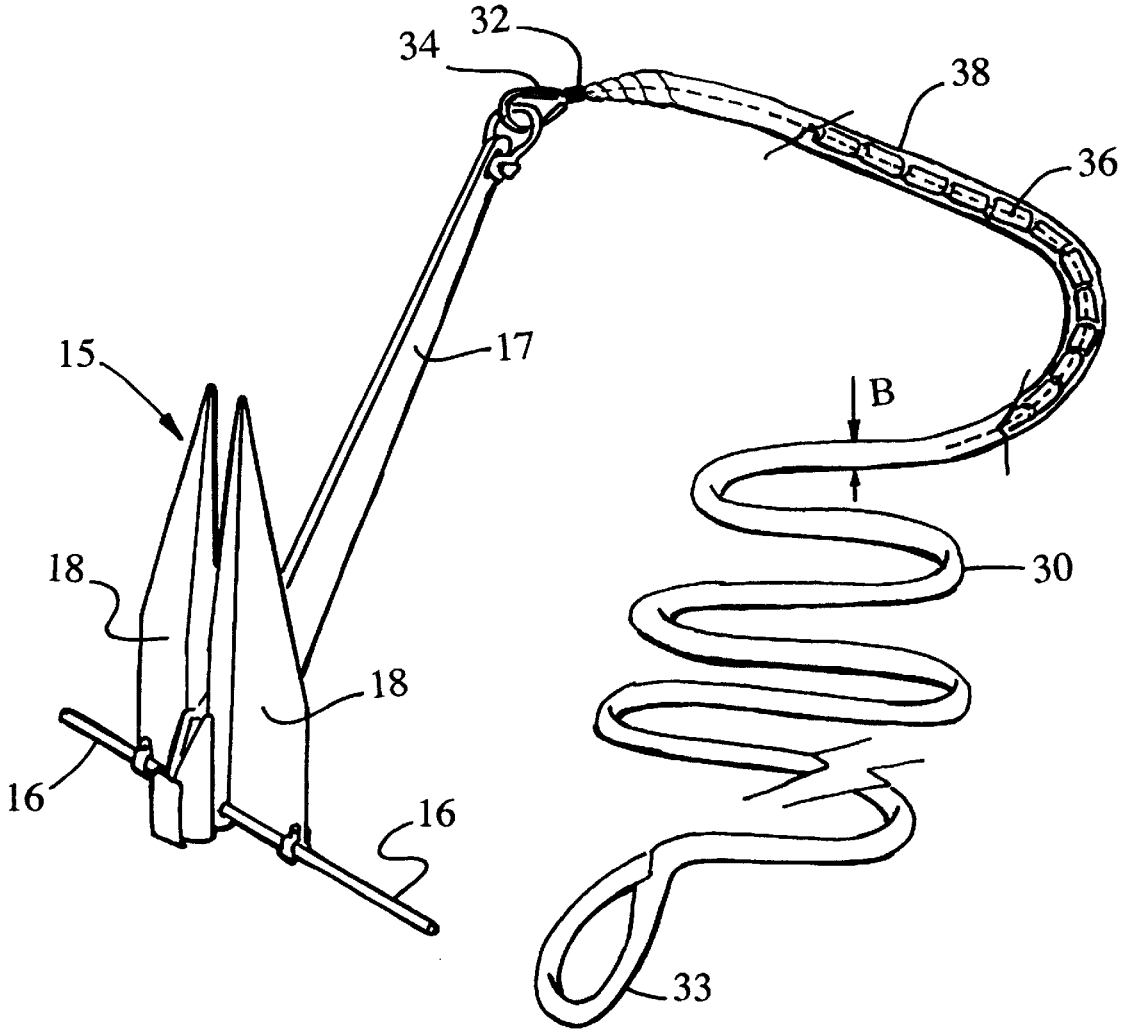
FIG. 4 is a perspective view of the anchor and rode with a partial cut-away section of the rode adjacent to the anchor-end.

FIG. 4 better illustrates the anchor 15 and rode 30 combination. As earlier stated, the anchor illustrated is a fluke-type anchor having at least two or more flukes 18, an anchor stock 16, an anchor crown 22, and an anchor shank 17. The attachment between the anchor 15 and the rode 30, unlike typical anchor-to-rode attachments, is chainless. Such attachments generally include a length of chain between the anchor and the rode to provide the weight necessary for the anchor, when deployed, to function and seat properly. As described earlier, chains by their very nature, are apt to easily foul and tangle; they are difficult to handle; they are difficult and cumbersome to stow and deploy. The system of the present invention contemplates a rode 30 which, at its anchor end 34, instead of having a chain, has internal weights 36 inserted thereon under the rode cover 38.

Most rodes are either double braided or 3-strand ropes. The braid rode has a rode core (not shown) and a cover 38, generally a nylon cover, covering the core. In the system of the present invention we have peeled back the cover and fastened a metal cable (preferably a stainless steel cable) to the rode core. Next weights 36 inserted onto the metal cable. The weights 36 are of sufficient weight to function as a chain substitute. The weights 36, however, do not extend to the end of the cable 32. Sufficient cable length is preserved to enable the cable to be connected to the anchor shank 17 and thereafter be turned inward toward the weights and fastened at a point adjacent to the last weight. A conventional thimble and shackle may be used to aid in attaching the cable to the anchor shank. The end of the cable is securingly fitted onto the cable section adjacent to the weights. Any conventional fitting mechanism and process will suffice. Lastly, the previously peeled cover is pulled toward the anchor end 34 of the rode to cover the weights 36 and provide the protective covering for the rode 30.

Good anchoring results have been achieved when weights have been placed on the cable at a point adjacent to its anchor end 34 and extending to a distance of about between 2.5% to 12.5% of the entire length of the rode 30. Best results, however, have been attained when the weights have been placed on the cable at a point adjacent to its anchor end 34 to a distance of about 7.5% of the entire length of the rode 30.

In addition to weight placement, diameters of the bag 20 and the rode 30 are important to proper stowing (and coiling) of the rode 30 into the bag 20. It has been found that the rode 30 will coil more naturally and, consequently, much more easily into the bag 20, and properly fall into place there, when the bag 20 has a certain inside diameter in relation to a certain outer diameter of the rode 30. In this regard, a diameter ratio between the bag and the rode 30 of between about 16.0 to 19.5:1.0 facilitates good natural coiling of the rode 30 into the bag 20 for storage. Best results have been achieved, however, with a diameter ratio between the bag 20 and the rode 30 of about 18.0:1.0.

The present disclosure for an anchor bag and anchor bag system of a lightweight, non-fouling, instantly deployable, chainless nature includes not only that contained in the present claims but that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiment[s] illustrated, but by the appended claims and their legal equivalents.

The invention claimed is:

1. An anchor bag having an inner chamber and an outer surface, said anchor bag for use in combination with a rode and an anchor having an anchor stock, an anchor shank, an anchor crown, and anchor flukes, said anchor bag comprising:

a mouth at one end of said bag;

a closed end at an opposite end of said bag; and anchor retainer means on the outer surface of said anchor bag for retaining the anchor to said anchor bag when in a stowed condition, said anchor retainer means comprising an anchor stock guard means for guarding one or more ends of the anchor stock from damage and from causing damage.

2. The anchor bag as defined in claim 1 further comprising a rode passage means structured at said closed end for passage of the rode therethrough.

3. The anchor bag as defined in claim 2 wherein said rode passage means comprises a reinforced aperture.

4. The anchor bag as defined in claim 1 further comprising a drying means on the outer surface in communicating relationship with the inner chamber to facilitate drainage of water from the anchor bag and to facilitate drying of the inner chamber and the rode therein when in its stowed condition.

5. The anchor bag as defined in claim 1 further comprising a carrying means for carrying the anchor bag.

6. The anchor bag as defined in claim 1 wherein said anchor retainer means further comprises a shank support means for supporting the anchor shank when the anchor is in a stowed condition.

7. The anchor bag as defined in claim 6 wherein said shank support means comprises two opposing flaps, removably connectable to each other, which when so connected to each other retain the anchor shank to said anchor bag.

8. The anchor bag as defined in claim 1 wherein said anchor retainer means further comprises a fluke support means to support the anchor flukes when the anchor is in a stowed condition.

9. The anchor bag as defined in claim 8 wherein said fluke support means comprises one or more pockets on the outer surface adapted to contain the anchor flukes.

10. The anchor bag as defined in claim 1 wherein said anchor stock guards comprise one or more end caps removably attachable to the one or more ends of the anchor stock.

11. The anchor bag as defined in claim 10 wherein said one or more end caps are attached to the outer surface of said anchor bag.

12. An anchor bag system for use in combination with an anchor having an anchor stock, an anchor shank, an anchor crown, and anchor flukes, for easily stowing and deploying the anchor, said anchor bag system comprising:

a container having an inner chamber and an outer surface;

a mouth at one end of said container;

a closed end at an opposite end of said container, said closed end having a rode passage aperture;

a rode traversing said rode passage aperture, said rode having a bitter end outside of the closed end and an anchor end opposite said bitter end, said anchor end attached to the anchor; and anchor retainer means on the outer surface of said container for retaining the anchor to said container when in a stowed condition, said anchor retainer means comprising an anchor stock guard means for guarding one or more ends of the anchor stock from damage and from causing damage.

13. The anchor bag system as defined in claim 12 further comprising a drying means on the outer surface in communicating relationship with the inner chamber to facilitate drainage of water from the container and to facilitate drying of the inner chamber and the rode therein when in its stowed condition.

14. The anchor bag system as defined in claim 12 further comprising a carrying means for carrying the container.

15. The anchor bag system as defined in claim 12 wherein said anchor retainer means further comprises a shank support means for supporting the anchor shank when the anchor is in a stowed condition.

16. The anchor bag system as defined in claim 15 wherein said shank support means comprises two opposing flaps, removably connectable to each other, which when so connected to each other retain the anchor shank to said container.

17. The anchor bag system as defined in claim 16 wherein said anchor retainer means further comprises a fluke support means to support the anchor flukes when the anchor is in a stowed condition.

18. The anchor bag system as defined in claim 17 wherein said fluke support means comprises one or more pockets on the outer surface adapted to contain the anchor flukes.

19. The anchor bag system as defined in claim 12 wherein said anchor stock guards comprise one or more end caps removably attachable to the one or more ends of the anchor stock.

20. The anchor bag system as defined in claim 19 wherein said one or more end caps are attached to the outer surface of said container.

21. The anchor bag system as defined in claim 12 wherein said rode is chainlessly connected to said anchor.

22. The anchor bag system as defined in claim 12 wherein said rode further comprises one or more internal weights extending from the anchor end of said rode to a distance of between about 2.5% to 12.5% of the length of the rode.

23. The anchor bag system as defined in claim 12 wherein said rode further comprises one or more internal weights extending from the anchor end of said rode to a distance of about 7.5% of the length of the rode.

24. The anchor bag system as defined in claim 12 wherein a ratio between an inside diameter of said inner chamber to an outside diameter of said rode is between approximately 16.0:1.0 and approximately 19.5:1.0.

25. The anchor bag system as defined in claim 12 wherein a ratio between an inside diameter of said inner chamber to an outside diameter of said rode is approximately 18.0:1.0.

* * * * *